US008893893B2

(12) United States Patent
Le Roux Cilliers

(10) Patent No.: US 8,893,893 B2
(45) Date of Patent: Nov. 25, 2014

(54) METHOD OF FROTH FLOTATION CONTROL

(75) Inventor: Johannes Jacobus Le Roux Cilliers, Palmers Green London (GB)

(73) Assignee: Imperial Innovations Limited (GB)

( * ) Notice: Subject to any disclaimer, the term of this patent is extended or adjusted under 35 U.S.C. 154(b) by 1262 days.

(21) Appl. No.: 12/681,228

(22) PCT Filed: Oct. 2, 2008

(86) PCT No.: PCT/GB2008/003348

§ 371 (c)(1),
(2), (4) Date: Jul. 1, 2010

(87) PCT Pub. No.: WO2009/044149

PCT Pub. Date: Apr. 9, 2009

(65) Prior Publication Data

US 2010/0276342 A1 Nov. 4, 2010

(30) Foreign Application Priority Data

Oct. 4, 2007 (GB) ..... 0719432.7

(51) Int. Cl.
*B03D 1/02* (2006.01)

(52) U.S. Cl.
CPC ..... *B03D 1/028* (2013.01)
USPC ..... 209/164; 209/1

(58) Field of Classification Search
CPC ..... B03D 1/028
USPC ..... 209/164, 1
See application file for complete search history.

(56) References Cited

U.S. PATENT DOCUMENTS 4,133,746 A * 1/1979 Dopson ..... 209/1
4,279,742 A * 7/1981 Ivanov et al. ..... 209/166

FOREIGN PATENT DOCUMENTS

EP 0709121 A2 5/1996
WO 0138001 5/2001
WO WO 2004/080600 A1 * 9/2004

OTHER PUBLICATIONS

Barbian et al. "The Froth Stability Column: Measuring Froth Stability at an Industrial Scale", Minerals Engineering 2006, vol. 19, p. 713-718.
Barbian et al. "The Froth Stability: Linking Froth Stability and Flotation Performance", Minerals Engineering 2005, vol. 18, p. 317-324.
Neethling et al. "Simple Relationships for Predicting the Recovery of Liquid from Flowing Foams and Froths", Minerals Engineering 2003, vol. 16, p. 1123-1130.
Hadler, "Down the Bank Froth Stability and Flotation Performance", A Thesis Submitted to the University of Manchester for the Degree of Doctor of Philosophy in the Faculty of Engineering and Physical Sciences 2006, School of Chemical Engineering and Analytical Science, 177 Pages.
Wills et al. "Froth Flotation", Wills Mineral Processing Technology 7th Edition, p. 267-352, 2006.

* cited by examiner

*Primary Examiner* — Thomas M Lithgow
(74) *Attorney, Agent, or Firm* — Brooks Kushman P.C.

(57) ABSTRACT

A method of controlling operation of a froth floatation cell for separating substances comprises introducing gas into liquid in the cell, creating a froth controlling gas flow rate into the cell in order to maximize gas recovery for the cell.

14 Claims, 7 Drawing Sheets

METHOD OF FROTH FLOTATION CONTROL

This invention relates to a method of controlling one or more froth flotation cells for separating substances.

This invention relates particularly, although by no means exclusively, to a method of controlling one or more froth flotation cells for separating minerals, for example minerals containing metals such as nickel and copper, from ore that contains the minerals and other material, typically referred to as gangue. The following description of the invention focuses on a froth flotation method for separating minerals from gangue, but the invention is not confined to this application.

One, although not the only other, example of a froth flotation method is de-inking of paper, wherein it is the undesired ink which is removed via the froth, and the desired paper that remains in the pulp in the flotation cell. Other examples of froth flotation methods are for protein separation, molecular separation and waste separation.

This invention also relates to a method of froth flotation in one or more froth flotation cells.

This invention also relates to a froth flotation cell and to a plant that comprises a plurality of froth flotation cells.

BACKGROUND

Froth Flotation

Mineral froth flotation is a known industrial process used for extracting valuable mineral content from ore obtained for example through mining. It is a surface chemistry process used to separate solids, typically fine solids, by exploiting the variation in hydrophilicity between different materials.

In a flotation cell or vessel, containing a pulp of matter such as ore from which the mineral is to be extracted mixed with liquid, air is flowed through the pulp and separation is achieved by the selective adherence of hydrophobic particles to gas bubbles whilst any hydrophilic particles remain in the liquid which flows between the gas bubbles in the vessel. When bubbles rise to the top of the vessel a froth is formed.

The froth can be arranged to overflow from the flotation vessel with both hydrophobic and hydrophilic particles comprised therein. Those particles can be extracted as a concentrate. The remaining pulp in the flotation vessel is commonly referred to as the tailings.

Cell Banks and Circuits

In practice a froth flotation plant will contain multiple cells, typically arranged in banks of similar type, where material is fed through the bank, cell by cell, and then on to the next bank. Cell types may differ between banks, the initial bank, for example, containing roughers which are used for initial crude separation of desired matter from undesired matter. Downstream, banks may include secondary roughers, also known as scavengers, which perform additional separation on the pulp which remains in a rougher after froth has been overflown therefrom. Downstream banks may also include cleaners, which perform separation on froth which has been extracted from roughers or scavengers.

Quantifying Performance

The performance quality of a flotation process can be measured with respect to two characteristics of the concentrate that is extracted from the flotation vessel—grade and recovery. Grade indicates the fraction of desired solids in the concentrate as compared to undesired solids (gangue). Recovery indicates the fraction of desired solids in the concentrate as compared to the fraction of desired solids in the original ore feed that was input into the flotation cell. A key aim of an industrial flotation process is to manipulate operating conditions in order to achieve an optimal balance between grade and recovery, with an ideal flotation process producing high recovery of high grade concentrate.

Controlling the Flotation Performance

It is known that several controllable factors can affect the performance quality of a flotation process. These include the pH of the pulp, the concentration of various chemicals added to the flotation vessel, the froth depth, solids concentration and air flow rate into the flotation vessel.

According to known methods of controlling and operating a froth flotation plant, a controller can observe a flotation cell and manually or otherwise adjust the inputs to the cell, for example by adding additional chemicals and/or changing the air flow rate into the cell, according to his or her observations. Typically these are empirical based particularly on observation of the froth surface and its behaviour. However, such methods of adjustment are often imprecise. Furthermore, changes in certain visual aspects of a flotation froth do not correspond necessarily to variation in output performance quality.

In addition, modern industrial processes make use of increasingly large flotation cells. This increase in size tends to encourage the use of increased power and air volume in flotation cells, regardless of performance considerations, increasing the inefficiency inherent in existing control and operation methods. Problems therefore remain in known practical flotation methods with respect to which variables should be observed, measured and controlled in order to optimise flotation performance, as well as how to manipulate those relevant variables accurately.

In particular, existing techniques do not provide both high grade and high recovery of the concentrate recovered from industrial flotation processes.

A discussion of investigating froth flotation performance is provided in Barbian et al, "*The Froth Stability Column—Measuring Froth Stability at an Industrial Scale*", Pages 315 to 319, *Centenary of Flotation Symposium, Brisbane, QLD* (6-9 Jun. 2005) in which correlations are identified between a froth stability factor, air rate and froth depth in a single cell A known technique for assessing flotation performance in a plurality of linked flotation vessels is described in Hadler, "*The relationship between Froth Stability and Flotation Performance Down a Bank of Cells*" (PhD thesis, University of Manchester, 2006.) Performance of the first four flotation cells of a rougher bank are cumulatively analysed. According to Hadler, the performance of linked flotation cells varies as the air addition profile, i.e. the difference in air flow rate between consecutive cells along the bank, varies. Hadler finds that a peak in stability exists in each cell in the bank as the air rate into the cell is changed. Over the range of air flow rates tested in Hadler, the cumulative grade of the concentrate decreases with increased air flow rate. Therefore low air rates and a rising air profile across the bank are employed.

In addition, the applicant is not aware of any known technique that can utilise straightforward and automatable measurement of parameters in order to reliably control operation of a group of flotation cells.

The above discussion is not to be taken as a description of the common general knowledge.

THE INVENTION

The invention provides a method of controlling operation of a froth flotation cell for separating substances, the method comprising introducing gas into liquid in the cell and creating a froth and controlling gas flow rate, for example by varying the flow rate, into the cell in order to maximise gas recovery for the cell.

The term "gas recovery for the cell" is understood herein to be a measure of the volume of air or other flotation gas in froth bubbles that overflow from a flotation cell as compared to the volume of air or other flotation gas in bubbles that burst within the cell and/or to the volume of air or other flotation gas introduced into the cell during a flotation process.

The invention also provides a froth flotation cell including a gas inlet for introducing gas into liquid in the cell, a monitor for monitoring overflow of froth from the cell for calculating gas recovery from input gas in froth which overflows the cell in use of the cell, and a controller for varying gas flow rate into the cell to maximise gas recovery.

The substances may be any substances that require separation and can be separated in a froth flotation process. As is indicated above, the invention is concerned particularly, although by no means exclusively, with separating minerals, for example minerals containing metals, from the remainder of an ore than contains the minerals.

By maximizing gas recovery in the cell the cell produces a high grade of concentrate from the froth which overflows the cell, whilst also obtaining a high recovery of the desired mineral to be recovered from the ore by the froth flotation process. In particular, in the context of mineral separation from ore, controlling operation of a froth flotation cell according to gas recovery considerations minimises the amount of gangue present in the concentrate, which improves performance with respect to both the grade and recovery of the concentrate.

It is recognised, in comparison with known approaches where only a limited range of air flow rates are tested, that changing air flow rate into a froth flotation cell has a non-insignificant effect on the recovery of concentrate therefrom. In particular it is recognised that low airflow rates result in slow travel of gas bubbles to the surface of a froth which can cause bursting of bubbles before they reach the overflow lip of the flotation vessel and that at low air rates bubbles may be overloaded with solid and collapse under their weight. Low air flow rates therefore result in fewer solid particles, both desired particles and undesired particles, being recovered per unit time. Therefore although the grade of the concentrate is improved according to known methods which focus on low air flow rates, the recovery is not significantly increased, unlike the present invention in which both grade and recovery of concentrate are optimised.

Because the air flow rate into the froth flotation cell is varied according to Gas recovery can be measured non-obtrusively during operation of the cell. Hence, it is possible to control operation of the cell in an entirely non-obtrusive manner.

Gas recovery may also be inferred by sampling the behaviour of froth in the cell, for example using a froth stability column. Hence, again, it is possible to control operation of the cell in a non-obtrusive manner.

By controlling operation of a bank comprising a plurality of froth flotation cells on a cell-by-cell basis using the control method described above, enhanced performance may be achieved for each cell and for the bank as a whole. In this context, it is relevant to note that control may be confined to a selected group of the cells and not all of the cells in the bank.

Similarly, by controlling a plant or other flotation circuit which includes a plurality of banks on a bank-by-bank basis, with each cell in each bank or a selection of the cells in each bank being controlled independently as described above, overall improved circuit performance may be achieved.

A straight-forward and automatable method is therefore provided for controlling operation of froth flotation cells and for improving the performance of the cells with respect to the grade and recovery of the minerals that are extracted therefrom. By improving both the grade and recovery of the concentrate, operation of the plant may be more efficient and more cost-effective.

Embodiments of the invention will now be described, by way of example, with reference to the Figures, of which:

Figure 4A:
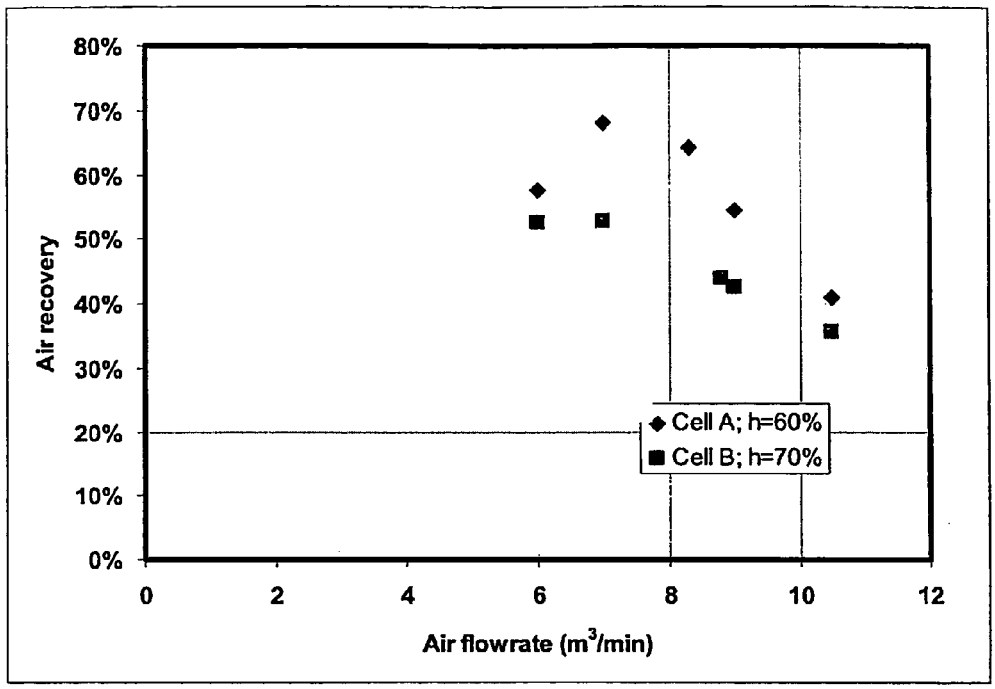
Figure 4B:
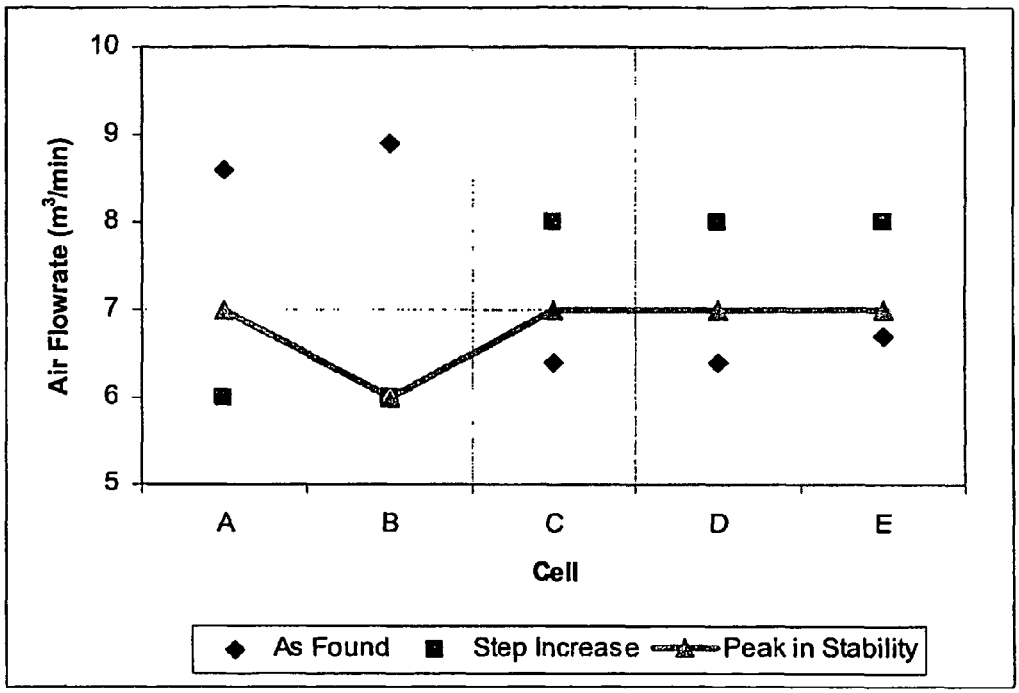

FIG. 4*a* shows a plot of air recovery versus air flow rate as found experimentally for two froth flotation cells according to an embodiment of the present invention;

FIG. 4*b* shows a plot of air flow rate for 3 different air profiles in a bank of 5 froth flotation cells according to an embodiment of the present invention, including those cells referred to in FIG. 4*a;*

Figure 4C:
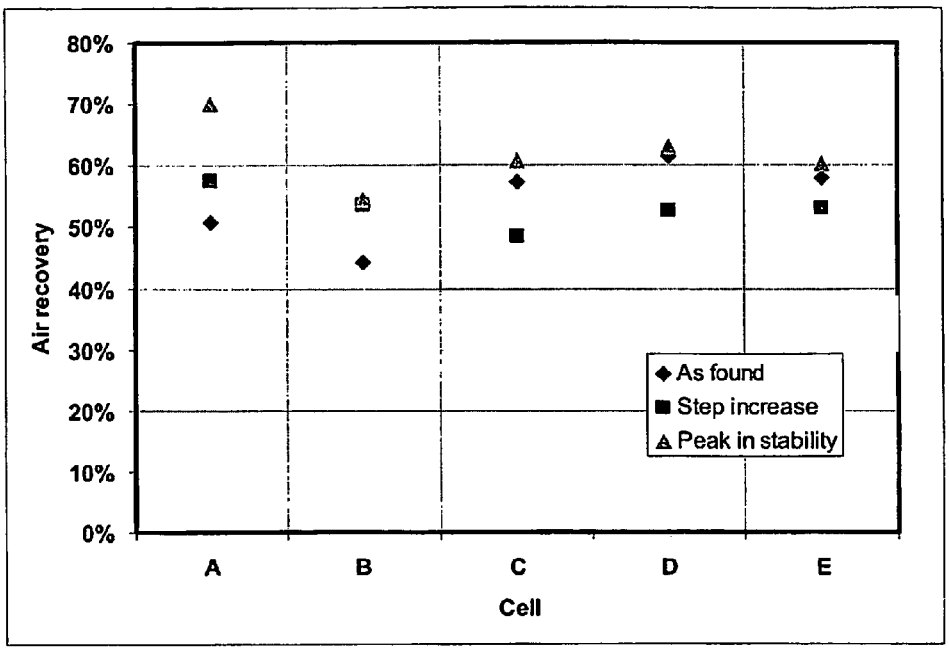

FIG. 4*c* shows a plot of air recovery for each air profile and in each cell as referred to in FIG. 4*b;*

Figure 4D:
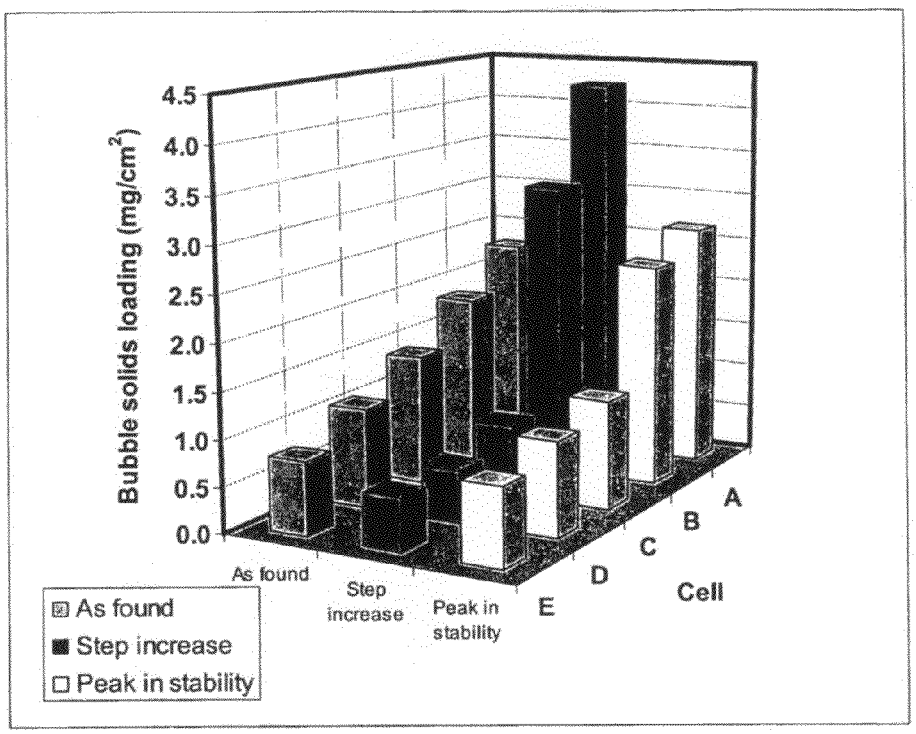
Figure 4E:
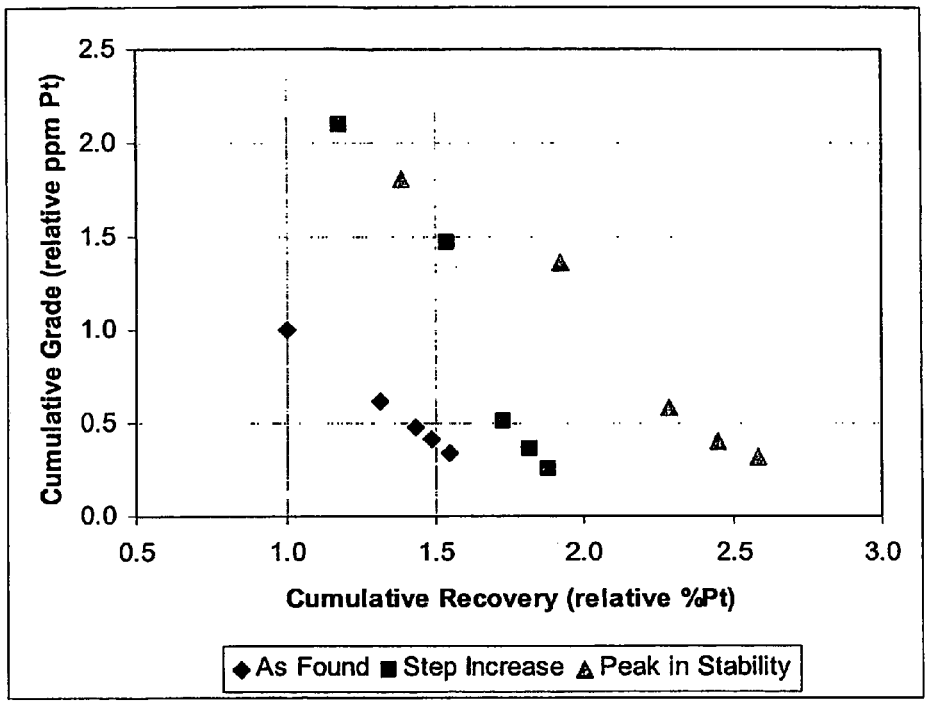

FIG. 4*d* shows a plot of bubble loading for each air profile and in each cell as referred to in FIGS. 4*b* and 4*c*; and FIG. 4*e* shows a plot of cumulative grade and cumulative recovery of concentrate for each air profile and in each cell as referred to in FIGS. 4*b* to 4*d*.

In overview, a method is provided for controlling operation of one or more froth flotation cells. In operation, air or other suitable flotation gas (including gas mixtures), such as nitrogen, is introduced into a froth flotation cell containing a slurry of a liquid and solid particles of an ore (including minerals containing valuable metal to be recovered) in order to create a froth. Overflow of the froth from the cell is then observed from which the air recovery (described above in more general terms as gas recovery) for the cell under the present operating conditions can be measured or inferred by appropriate method. The operation of the cell is controlled by varying the input air flow in order to maximise air recovery.

In a bank comprising a plurality of froth flotation cells, in one embodiment the air flow rate into each cell is varied individually in order to achieve air recovery maximization for that cell and therefore the bank.

In another, although not the only other embodiment, the air flow rate into a selection of cells in the bank is varied, with each cell being varied individually in order to achieve air recovery maximization for the bank.

Similarly, in a plant or circuit comprising a plurality of banks, each bank is controlled independently of the others.

The method is preferably a closed loop process so that the air flow rate variation takes into account the fluctuating operating conditions of the froth flotation cell, which will determine the precise air flow rate which achieves maximum air recovery at any given time. Further preferably, only air recovery maximization is taken into account when determining the air flow variation to be implemented.

Figure 1:
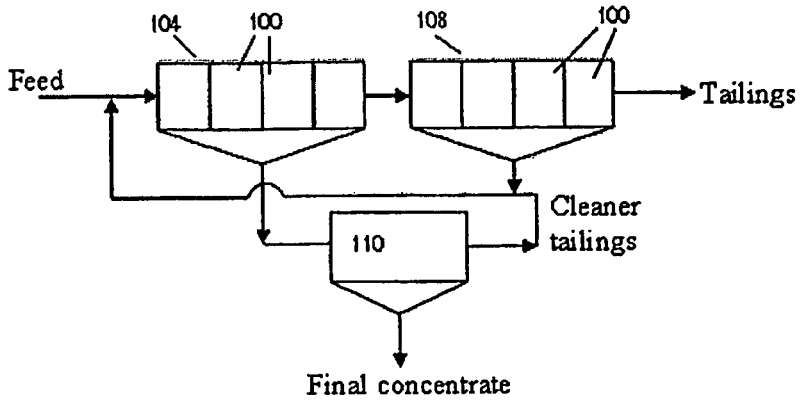
FIG. 1 shows a schematic view of an embodiment of a flotation circuit

Referring to FIG. 1, the apparatus is shown generally as a circuit having a number of banks or sub-banks, each including a plurality of froth flotation cells 100. It will be appreciated that the particular layout of the flotation circuit, the numbers of cells 100 that comprise each bank or sub-bank and the flow configuration of the various streams can vary widely. Each bank or sub-bank of cells may include any number or arrangement of cells 100, dependent on the practical conditions to be achieved. The cells 100 are connected to one another by any known means so that at least some of the contents of one cell 100 can be channeled into another cell 100. The practice of froth flotation and the design of such operations is known to the skilled person and is described in detail in, for example, *Wills' Mineral Processing Technology,* $7^{th}$ edition (Wills, B. A. and Napier-Munn, T.).

A mixture of two or more substances can be added to a froth flotation cell or cells for separation, either wherein a desired substance is extracted from the froth which overflows the cell or wherein the froth includes undesired substances, so that a desired substance can be extracted from the pulp which remains in the cell after operation. In the context of the minerals industry, the substances are metal-containing minerals in an ore containing the minerals and gangue.

In the embodiment shown in FIG. 1 the flotation circuit includes a bank of rougher cells 104 into which a feed slurry of ore and a liquid, typically water, is introduced. Downstream from the rougher bank 104 there is provided a secondary rougher or "scavenger" bank 108 and a cleaner bank 110. Optionally, the circuit may include more than one rougher 104, scavenger 108 or cleaner 110 bank or sub-bank. In addition, both cleaners 110 and re-cleaners may be included. According to the embodiment as shown, both the cleaner 110 and the scavenger 108 include feedback channels for re-introducing material into the rougher 104 for additional processing.

In operation, ore from which a desired metal-containing mineral is to be separated and then extracted is crushed using any appropriate means. The crushed matter is then fed into a mill to be further broken down into a fine particle size for example powder. The required particle size in any given situation will be dependent on a range of factors, including minerology, etc and can readily be determined. After milling, the particles are chemically treated in order to induce the appropriate wettability characteristics of the desired mineral which is to be separated and then extracted using the flotation process. According to a preferred embodiment, the particles are treated so that the surface of desired mineral is both hydrophobic and aerophilic. This ensures that the mineral will be strongly attracted to an air interface such as a gas bubble and that air or other flotation gas will readily displace water at the surface of the desired mineral.

All undesired matter is preferably chemically treated so as to be hydrophilic. The methods for chemical treatment of the particles are well known and so are not discussed further herein.

In order to carry out a froth flotation process and separate and extract the desired mineral, the chemically treated particles are introduced as feed into a cell 100 in which water or other liquid is present. Bubbles of air or other gas are then introduced into the feed/liquid slurry at a controlled rate via one or more gas inlets (not shown). Typically, the air is supplied to the gas inlet or inlets of the cell 100 via a blower or other suitable apparatus. During this operation of the cell 100, the feed slurry at least partially separates so that at least some of the hydrophobic particles of desired mineral adhere to the gas bubbles whilst hydrophilic particles of undesired material and, dependent on conditions in the cell, some of the hydrophobic particles, will remain in the liquid.

The difference in density between the gas bubbles and the liquid dictates that the bubbles rise to the upper surface of the slurry in the cell 100, to create a froth thereon. The froth contains both bubbles and liquid which flows in the channels formed between the bubbles. The froth therefore contains both desired particles and undesired particles. In order for the desired particles to be extracted, conditions in the cell 100 are controlled so that at least some of the froth overflows from the cell 100. The froth that overflows or is removed from the cell 100 is either introduced into a further flotation cell 100 and/or forms a concentrate which includes the desired mineral to be recovered therefrom. Methods of concentrate recovery from froth and methods of extraction of valuable materials from such a concentrate will be well known such that further discussion of these is not provided.

In the embodiment shown in FIG. 1, once feed has been introduced into the rougher 104, the rougher 104 performs a froth flotation process as described above. The froth produced by the rougher 104 during that process is channeled into the cleaner 110 whilst the tailings from the rougher 104 are introduced into the scavenger 108. Both the scavenger 108 and the cleaner 110 then perform a froth flotation process as described. The froth produced by the scavenger 108 and the tailings produced by the cleaner are reintroduced into the rougher 104 for further processing. The tailings from the scavenger 108 are then discarded whilst the froth output from the cleaner 100 is harvested for extraction of the final concentrate as described above.

A range of variables and operational boundary conditions in the froth flotation cells 100 can be monitored and controlled in an attempt to achieve good recovery and good grade of the extracted concentrate.

Experimental tests carried out by the applicant using air as the flotation gas have shown that for an individual flotation cell, there is a peak in air recovery as air flow rate into the cell increases. In addition, it has been shown that optimum froth stability is achieved under conditions at which there is a peak in air recovery, which results in improved flotation cell performance.

The present method utilises these operational characteristics in order to optimise performance of a bank of cells.

According to the present method, therefore, the key boundary condition which is controlled is the air recovery, and in particular the air recovery of each individual flotation cell 100 in the flotation circuit.

Air recovery can be calculated from any one or more of the following measurements: the height of the froth overflowing a flotation cell, obtained for example by measuring the height of the tide mark on a scaled vertical surface perpendicular to the overflow lip; the velocity of the froth overflowing the cell, obtained via image analysis of a flotation cell in operation; the length or perimeter of the cell from which the froth overflows, known to the user from plant measurements; and the air flow rate into the cell, which is controlled by the user. Each of these measurements can therefore either be pre-determined by the user or can be calculated using image analysis. As a result, air recovery can be monitored, measured and controlled in a non-intrusive manner, without touching the froth or other contents of the flotation cell. The methods of image analysis to be used and the calculations involved will be known to the skilled person and may be found, for example, in Barbian referenced above. No further detail on this point is therefore provided. As an alternative to measuring air recovery directly as described above, air recovery can be derived or inferred using, for example, a froth stability column.

According to an embodiment of the method, as a first step the air recovery in a first cell of a bank is measured over a range of input air flow rates. If the cell is already operational, the first air flow rate for which a measurement is taken is the "as-found" flow rate. If the cell is being set up for the first time, the air flow rate at which to first measure air recovery will be estimated by the user according to his or her knowledge of the plant and flotation process to be carried out. Sufficient measurements are carried out in order to find the air flow rate at which the peak in air recovery, and hence the peak in stability, is found. The first cell is then calibrated to operate at all times at the air flow rate which achieves peak air recovery for that cell. It will be appreciated that the conditions in a flotation cell, for example temperature, pressure, chemical composition and the quality of the ore particles introduced into the cell, change continuously during operation of the cell. Accordingly the calibration process can be carried out for a range of operating conditions and the required air flow rate selected dependent on the conditions, for example from a look-up table. Alternatively or in addition, the cell control can be a closed loop process, continuously monitoring air recovery so that air flow rate can be adjusted to provide a peak in air recovery at any given time, based on the current operating conditions. Air recovery may be calculated continuously or periodically.

In order to optimise performance of a bank of cells, an integrated approach may be adopted wherein each cell is individually calibrated to operate at the air flow rate which achieves peak air recovery for that cell at any given time as described above. The air flow rate is therefore controlled separately for each cell, regardless of the down-bank air profile which results from this. Each type of flotation cell bank or sub-bank—roughers 104, scavengers 108 and cleaners 110—operates using a similar froth flotation technique, and therefore each of these types of cells can be individually calibrated and/or controlled to achieve peak air recovery for that cell. Hence optimisation is not restricted to the first cell in a bank or to a particular bank type, but instead performance is optimised throughout a flotation circuit using air recovery per cell as the control parameter. In particular by controlling and maximising air recovery for each individual cell, observed differences in air recovery for a common air flow rate between cells in a bank or sub-bank can be accommodated.

Figure 2:
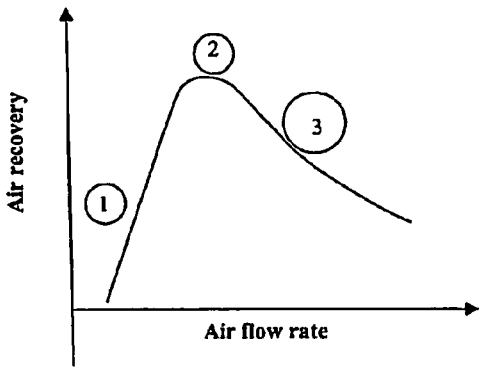
FIG. 2 shows a plot of air recovery versus air flow rate for a froth flotation cell according to an embodiment of the present invention.
Figure 3:
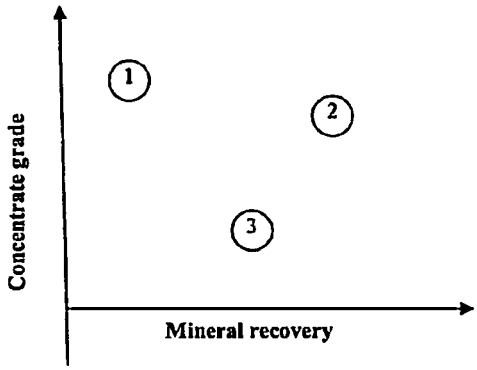
FIG. 3 show a plot of concentrate grade versus mineral recovery at 3 different air flow rates for a froth flotation cell according to an embodiment of the present invention.

The enhanced performance that can be achieved using the method described above and in particular the relationship between air recovery and performance can be understood in more detail with respect to FIGS. 2 and 3. The skilled person will appreciate that flotation froths are stabilised by the hydrophobic particles. The amount of particles which become loaded onto the bubbles is an important factor in the stability of the froth and will depend on the input air flow rate. The peak in air recovery is therefore due to the balance of loading on the bubbles to stabilise them (which generally decreases with increasing air rate), and the flow velocity to the overflow lip of the flotation cell (which generally increases with increasing air rate, until the air recovery is too low because the bubbles burst too quickly).

Referring to the numbered points on FIG. 2, the relationship between air recovery and air flow rate is explained as follows:

1. At low air flow rates the bubbles are heavily loaded as the ratio of hydrophobic particles to bubble surface area is relatively low. This prevents coalescence and bursting. Because the air flow rate is low, in the froth the bubbles also travel slowly and therefore coalesce and burst due to the long time before they reach the overflow lip of the cell, resulting in a low air recovery. Low air flow rates may result in such heavy particle loads that the froth collapses under its own weight, also decreasing the air recovery.
2. As air flow rate to the cell is increased, particle loading on bubbles decreases, but remains high enough to stabilise the bubbles. The froth is now also flowing faster and bubbles reach the lip before they burst, resulting in an increased fraction of air overflowing the weir (high air recovery).
3. If air flow rate is increased further, the particle-bubble ratio becomes very low, the particle load on the bubbles is low, reducing their stability and the bubbles rapidly burst (low air recovery).

The relationship between air recovery and air rate can now be understood. As described above, flotation performance is a balance between concentrate recovery and concentrate grade. Each of these characteristic measurements is high when the performance of a flotation cell is at its peak. In operation of a flotation cell, the majority of desired solid particles enter the froth attached to bubbles. However, most detach and become entrained in the liquid flowing in channels between bubbles before reaching the lip of the cell. The undesired solids come into the froth by entrainment in the liquid flowing in channels between bubbles. The recovery of both entrained solids and those still attached to bubbles is therefore increased by more bubbles overflowing the lip, which is increased both by high air rates and by high air recovery. As a result, the optimisation of performance of a flotation cell as achieved in the described method is due to an increase in extraction of desired solids as the air recovery increases, balanced with a limited increase of entrained undesired solids because the air flow rate is not significantly increased in the relevant operating range. Referring to the numbered points in FIG. 3, which correspond to the air flow rate and air recovery points on FIG. 2, this relationship between optimal performance and air recovery can be understood in more detail as follows:

1. At low air flow rates there is a low desired mineral recovery due to the low air recovery. A high grade is obtained due to low undesired solids entrainment as a result of low air rates and low air recovery.
2. As the air flow rate to the cell is increased towards the peak in air recovery, the mineral recovery increases as the flow of bubbles over the lip increases with an attendant high air recovery. The concentrate grade decreases somewhat due to an increase in entrainment caused by higher air rate and high air recovery. This decrease is relatively small, since the air flow rate is still low enough to limit the entrainment of undesired solids.
3. If air flow rate is increased further past the peak in air recovery, desired solids recovery slows as a result of the lower air recovery. The concentrate grade also decreases, now significantly, because of the high air rate causing a high degree of entrainment of undesired solids.

Experimental tests have been employed by the applicant to investigate this theory and to show that switching from using known methods of controlling operation of froth flotation cells to using the present method increases both the grade and recovery of the concentrate retrieved, both on an individual cell basis and on a cumulative bank basis.

FIGS. 4*a* to 4*e* show results of one such experiment carried out by the applicant on an existing operational froth flotation circuit which comprises a plurality of rougher, scavenger and cleaner cells. The experiment comprised a rougher bank comprising 5 cells, labelled A to E, being used to obtain platinum from ore. The method employed comprised measuring the air recovery for the first 2 cells in the bank over a range of air flow rates in order to find the peak in stability for each cell. This information was then used to carry out surveys down the bank at the "as found" air profile and at other air profiles, including that which gives the peak in stability for the bank.

FIG. 4*a* shows air recovery versus air flow rate for cells A and B in the rougher bank tested. It can be seen that for each of these cells there is a peak in air recovery, which is known to correspond to a peak in stability, and that the air flow rate at which the peak occurs is different for each cell. For both cells, the air recovery decreases significantly as air flow rate is increased away from the peak. The air recovery peak was not actually measured for cells C to E. Instead, the results obtained for cells A and B were used to approximate a "peak in stability" air profile for the bank, as shown in FIG. 4*b*.

FIG. 4*b* shows 3 different air profiles for which surveys were carried out on the bank of 5 cells. In addition to measuring performance at the "as found" and "peak in stability" profiles, performance was measured for a "step increase" profile in which the air flow rate was low (less than or equal to the "peak in stability" air flow rate) and constant for each of cells A and B and was high (greater than the "peak in stability" air flow rate) and constant for each of cells C to E, with a step increase in air flow rate between cells B and C. As shown in FIG. 4*c*, the air recovery in each cell was measured for each of the 3 air profiles. The bubble loading for each of the 3 air profiles was also measured, as shown in FIG. 4*d*. Finally, the cumulative grade and cumulative recovery of retrieved concentrate was measured for each of the 3 air profiles, as shown in FIG. 4*e*.

FIG. 4*c* demonstrates that even with the air flow rate for cells C to E being approximated rather than being precisely optimised, the "peak in stability" air profile resulted in the highest air recovery for each of cells A to E. The bubble loading was high for cells A and B in the "step increase" profile, however it was very low for cells C to E in that profile. In the "peak in stability" profile, the bubble loading was increased from the "as found" profile for cells A and B. The bubble loading for cells C to E in the "peak in stability" profile was approximately equal to or slightly less than that for the "as found" profile. However the bubble loading in cells C to E was significantly higher in the "peak in stability" profile than in the "step increase" profile.

As shown in FIG. 4*e*, the "peak in stability" profile produced a higher cumulative grade and a higher cumulative recovery than each of the other 2 profiles. Comparing the results for the "step increase" profile to the "peak in stability" profile, the theory as described above in relation to FIGS. 2 and 3 is demonstrated in practice:

The first 2 cells in the "step increase" profile have high bubble loading; therefore they produce high cumulative grade concentrate. However, because of their low air flow rates these cells operate at low air recovery, which results in low recovery of Platinum. The last 3 cells in the "step increase" profile have low bubble loading and so produce low grade concentrate. These cells also operate at a high air flow rate; therefore have low air recovery and a resulting low cumulative Platinum recovery. In contrast, each of cells A to E in the "peak in stability" profile operates at high or maximum air recovery, therefore they produce high cumulative recovery of platinum. In addition, because the air flow rate is relatively low and therefore the bubble loading relatively high in the "peak in stability" profile, at least for cells A and B, a good grade of concentrate is achieved. It is anticipated that if each of cells C to E were individually measured and maximised with respect to air recovery, the resulting air profile would result in even better cumulative recovery than that which has been shown in this experiment, without compromising the cumulative grade achieved.

The method according to embodiments of the present invention thus enables individual cells in a bank to be individually calibrated and/or controlled in order to maximise air recovery and hence achieve optimum performance from that cell and also results in significantly improved cumulative performance of a bank of cells. It will be appreciated that in a preferred embodiment the operation of each flotation cell in a bank, plant or other circuit of cells will be optimised using air recovery maximization, however it is possible to maximise air recovery for any number of cells within a circuit in order to improve cumulative grade and recovery of the concentrate extracted therefrom.

By using air recovery as the control parameter, the method enables an increased amount of desired solids to be extracted from particles or other matter which is fed into a flotation cell, whilst at the same time limiting the amount of undesired solids extracted from the cell. By using this approach of minimising the amount of undesired material extracted, the method achieves enhanced performance with respect to both grade and recovery of desired solid, as compared to known processes which concentrate on achieving high proportions of desired material and as a result only optimise at best one or other of grade and recovery.

The method according to embodiments of the present invention is straightforward to carry out as it only uses known measurements and measurements which can be obtained from image analysis of a flotation cell in operation. No complicated calculations are required in order to calibrate the flotation cells. As a result, the method can be used for troubleshooting and as an optimisation tool for flotation performance improvement. There is also potential for use in closed loop control. Furthermore, air recovery tests as described can be used as a quick and reliable method for designing an experimental program.

A control program can be designed in order to control the operation of a plant or bank of froth flotation cells according to the method described above. In particular, a computer-implementable program can be designed for controlling operation of a plant or bank of froth flotation cells, wherein the air flow rate into each individual cell is varied in order to achieve optimal air recovery from that cell throughout operation, under any given operating conditions. It is also possible to determine the solution which achieves this control for a particular plant or bank for one or more predetermined sets of operating conditions, and to record this solution on a computer readable medium, for execution at the plant or bank.

The above described methods have been directed mainly to extracting mineral from ore however it will be appreciated that the control and calibration methods can be used in any froth flotation process. Examples include de-inking of paper, wherein it is the undesired ink which is removed via the froth, and the desired paper that remains in the pulp in the flotation cell. The present method can also be used for calibration and control of froth flotation cells for protein separation, molecular separation and waste separation.

The invention claimed is:

1. A method of controlling operation of a froth flotation cell for separating substances, the method comprising:

introducing gas into liquid in the cell and creating a froth, and controlling the cell by a closed loop process, said closed loop process comprising the step of continuously monitoring a gas recovery for the cell based on current operating conditions of the cell by monitoring overflow of froth from the cell and deriving therefrom the gas recovery for the cell in operation, and said closed loop process further comprising the step of controlling a gas flow rate into the cell solely in order to maximize the gas recovery for the cell.

2. A method as claimed in claim 1 comprising monitoring gas recovery from the input gas which is comprised in the froth which overflows the cell.

3. A method as claimed in claim 1 comprising sampling froth behaviour in the cell and deriving gas recovery from the sampling.

4. A method as claimed in claim 3 in which sampling is carried out using a froth stability column.

5. A method as claimed in claim 1 further comprising adding a mixture including both desired matter to be recovered and undesired matter to be discarded into the cell, wherein the cell is operable to perform at least partial separation of the mixture.

6. A method as claimed in claim 5 wherein the mixture includes froth overflow from a froth flotation cell.

7. A method as claimed in claim 1 wherein the substances are contained in an ore and the ore contains minerals to be separated from the remainder of the ore, and the method comprises supplying a slurry of the ore and a liquid to the cell, introducing gas into liquid in the cell and creating a froth and controlling gas flow rate into the cell solely in order to maximise gas recovery for the cell.

8. A method of controlling operating of a bank of froth flotation cells including individually controlling cells according to the method of claim 1.

9. A method of controlling operation of a plant comprising a plurality of froth flotation cell banks including individually controlling banks according to the method of claim 8.

10. A method of operating a froth flotation cell including controlling the cell according to the method of claim 1.

11. A method of operating a bank or plant comprising a plurality of froth flotation cells including operating cells individually according to the method of claim 10.

12. A method of obtaining a substance from a mixture of two or more substances including adding said mixture to a froth flotation cell, operating the cell according to the method of claim 10, and obtaining the substance from the froth which overflows the cell during operation.

13. A method of obtaining a substance from a mixture of two or more substances including adding said mixture to a froth flotation cell, bank or plant, operating the cell, bank or plant according to the method of claim 10, and obtaining the substance from the matter which remains in the froth flotation cell, bank or plant after operation.

14. A method of controlling operation of a froth flotation cell for separating substances, the method comprising:

introducing gas into liquid in the cell and creating a froth;

controlling the cell by a closed loop process, said closed loop process comprising:

continuously monitoring overflow of the froth from the cell and deriving therefrom a gas recovery for the cell in operation based on current operating conditions of the cell; and controlling a gas flow rate into the cell based on the monitored overflow of the froth exclusively to maximize the gas recovery for the cell, the gas flow rate not being controlled based on any parameter other than the gas recovery.

* * * * *